United States Patent [19]

Hakes

[11] 4,042,215

[45] Aug. 16, 1977

[54] WINCH CONTROL MECHANISM

[75] Inventor: Dewey R. Hakes, Geneseo, Ill.

[73] Assignee: Caterpillar Tractor Co., Peoria, Ill.

[21] Appl. No.: 552,091

[22] Filed: Feb. 24, 1975

[51] Int. Cl.[2] ..... B66D 1/00

[52] U.S. Cl. ..... 254/187.4; 60/562

[58] Field of Search ..... 254/166, 187 G, 150 R, 254/150 FH, 187 H; 192/12 R, 8 R; 60/571, 572, 567, 568, 581, 594, 562; 74/470; 92/130 C, 130 D; 191/12.2 R, 12.2 A; 214/85.5, 1 C, 1 M

[56] References Cited

U.S. PATENT DOCUMENTS

| | | | |
|---|---|---|---|
| 2,162,114 | 6/1939 | Oliver | 60/562 |
| 2,284,974 | 6/1942 | Gates | 60/562 |
| 2,352,344 | 6/1944 | Rockwell | 60/572 |
| 2,432,712 | 12/1947 | Bachman et al. | 60/571 |
| 2,453,852 | 11/1948 | Milster | 60/562 |
| 2,607,321 | 8/1952 | Lado | 60/571 |
| 2,997,849 | 8/1961 | Shimanekas | 60/572 |
| 3,512,361 | 5/1970 | McCaffery | 60/562 |
| 3,841,608 | 10/1974 | Schmitt et al. | 254/187 H |

FOREIGN PATENT DOCUMENTS

| | | | |
|---|---|---|---|
| 706,196 | 3/1963 | Canada | 60/571 |
| 1,185,494 | 10/1957 | France | 60/571 |
| 971,491 | 2/1959 | Germany | 60/571 |
| 956,485 | 4/1964 | United Kingdom | 60/571 |

*Primary Examiner*—Robert J. Spar
*Assistant Examiner*—Kenneth Noland
*Attorney, Agent, or Firm*—Phillips, Moore, Weissenberger, Lempio & Majestic

[57] ABSTRACT

A pilot control mechanism for regulating operation of a rotatable winch drum through a power train including a normally engaged brake securing the winch drum against rotation and a normally disengaged clutch being selectively engageable for driving the winch drum in a reeling-in mode, the pilot control mechanism including a pilot controlled lever operatively coupled with the normally engaged brake and the normally disengaged clutch and a manual control lever, a pair of slave cylinders and a pair of master cylinders being respectively coupled with the pilot controlled lever and the manual control lever in order to operate the normally engaged brake and normally disengaged clutch under different rates of modulation.

2 Claims, 4 Drawing Figures

WINCH CONTROL MECHANISM

BACKGROUND OF THE INVENTION

The present invention relates to a pilot controlled mechanism adapted to provide different rates of modulation depending upon the direction of movement for a manual control lever. More particularly, the pilot control mechanism is adapted to regulate operation of a rotatable winch drum through a power train including a normally engaged brake and a normally disengaged clutch.

For a winch unit of the type referred to above, it is common to provide for operator control over both reeling-in and reeling-out operation of the winch drum. For example, where the power train for the winch drum includes a normally engaged brake and a normally disengaged clutch, the brake may be gradually disengaged to permit reeling-out of cable from the winch drum while the clutch is selectively engaged in order to reel in cable upon the drum. The normally engaged brake may also be simultaneously disengaged along with engagement of the clutch.

When the winch unit is arranged upon a log skidder or similar machine, an operator may be required to perform a number of control functions for the vehicle, the winch unit and possibly other implements as well. Accordingly, it is desirable to provide a single control element for operating the power train for the winch unit to accomplish both reeling-in and reeling-out modes of operation.

A substantial load is normally secured to the cable during reeling-out operations of the type contemplated by the present invention. Accordingly, it is necessary to provide closely controlled modulation over disengagement of the brake in order to permit adequate operator control over the rate at which cable is reeled out from the drum.

Reeling-in of the cable is also accomplished with a load normally attached to the cable. However, since reeling-in of the cable is accomplished through a normally disengaged clutch, it is often desirable to provide for rapid modulation for engagement of the clutch as compared to disengagement of the normally engaged brake.

SUMMARY OF THE INVENTION

Accordingly, it is an object of the present invention to provide a pilot control mechanism which is capable of operation under different rates of modulation in order to selectively actuate first and second motor means.

It is a further object of the invention to provide such a pilot control mechanism including a pilot controlled lever movable in first and second directions for respectively actuating the first and second motor means, a manual control lever being interconnected with the pilot control lever by means of master cylinders and slave cylinders interconnected with the respective levers to provide for different rates of modulation in operation of the first and second motor means while developing proportional feedback forces within the manual control lever.

It is still a further object of the invention to provide such a control mechanism for operating the power train of a winch unit.

Additional objects and advantages of the invention are made apparent in the following description having reference to the accompanying drawings.

DESCRIPTION OF THE PREFERRED EMBODIMENT

Figure 1:
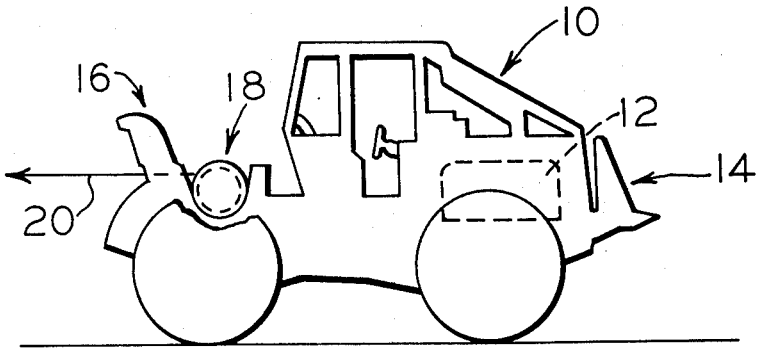
FIG. 1 is a side elevation view of a log skidder vehicle including a towing or logging winch adapted for operation by the control mechanism of the present invention.

The control mechanism of the present invention is described below in particular detail relative to a winch unit of the type schematically represented in FIG. 2 and adapted for use on a log skidder as illustrated in FIG. 1. However, it will be apparent from the following description that the control mechanism may be employed for other applications as well, particularly applications wherein a single control lever is movable for regulating opration of first and second motor means at different rates of modulation.

Referring now to FIG. 1, the control mechanism of the present invention is particularly adapted for operation of a towing or logging winch included within a log skidder vehicle of the type indicated at 10 in FIG. 1. The vehicle includes a prime mover or engine as illustrated in phantom at 12. In order to adapt the vehicle for logging operations, it may include various implements such as a bulldozer blade 14 movably mounted upon one end of the vehicle. In order to also adapt the vehicle for towing operations, it includes a logging arch arranged upon the other end of the vehicle at 16 and a winch unit 18 adapted for operation by the control mechanism of the present invention.

Construction and operation of the winch unit 18 is described in greater detail below having reference also to FIG. 2. However, it is generally noted that the winch unit 18 is operable in either a reeling-in or reeling-out mode of operation in order to permit operator control over a load (not shown) connected to a cable 20 associated with the winch unit 18 as described below.

Figure 2:
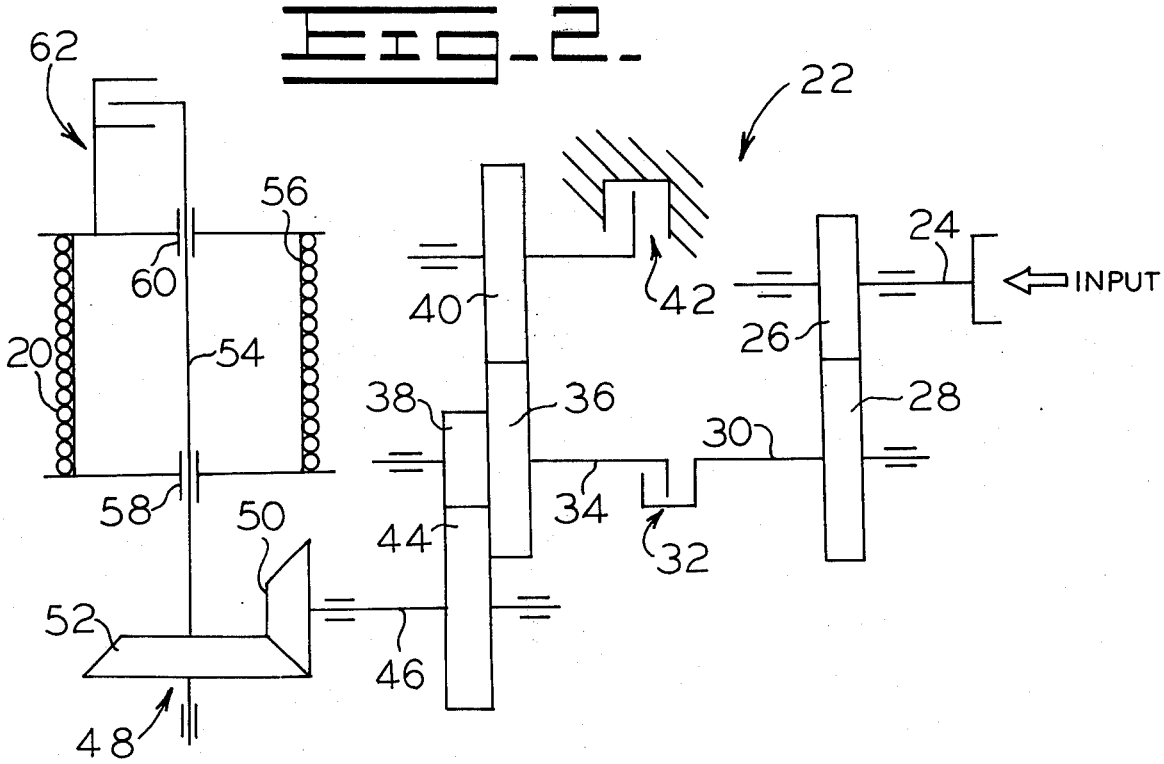
FIG. 2 is a schematic representation of a drive train for the winch unit of FIG. 1.

Referring also to FIG. 2, a power train indicated at 22 for the winch unit 18 includes a power input shaft 24 which may comprise a standard power take-off from the prime mover 12 for the vehicle in FIG. 1. The input shaft 24 is coupled by means of meshing transfer gears 26 and 28 with an input shaft 30 for a normally disengaged friction clutch 32. An output shaft 34 for the clutch 32 is coupled with a clutch output gear 36 which is also secured for rotation with a transfer gear 38. The clutch output gear 36 meshes with a brake gear 40, a normally engaged friction brake 42 being operable to secure the brake gear 40 against rotation.

The components described above comprise an intermediate portion of the drive train. The normally disengaged clutch 32 permits driving operation of the gear components within the intermediate drive through the input shaft 24. The normally engaged brake 42 tends to be disengaged as the clutch 32 is engaged and conversely tends to be engaged as the clutch 32 is disengaged. Thus, the brake 42 normally serves to prevent rotation of the intermediate drive train or at least those components on the output side of the clutch 32 when the clutch is disengaged. As described in greater detail below, the brake 42 is also adapted to be gradually disengaged without concurrent engagement of the clutch in order to permit reeling-out operation of the winch unit.

An output portion of the which drive train 22 includes a transfer gear 44 arranged in meshing engagement with the transfer gear 38. The gear 44 is mounted upon an input shaft 46 for a bevel gear assembly 48 having bevel gears 50 and 52. A winch drum shaft 54 provides an output for the bevel gear assembly 48 with a winch drum 56 being arranged for rotation upon the shaft 54 by means of bearings 58 and 60. The cable 20 is trained about the winch drum 56 to permit reeling-in or reeling-out of the cable according to rotation of the drum 56 under influence of the brake 42 and/or the clutch 32.

The power train 22 also includes a normally engaged clutch 62 which may be separately disengaged to permit free-wheeling of the winch drum 56. The free-wheeling clutch 62 is arranged for selective engagement between the drum 56 and its shaft 54.

For purposes of the present invention, it is sufficient to understand that the brake 42 may be gradually disengaged in order to permit reeling-out of the cable 20 under an external load (not shown). On the other hand, the clutch 32 may be gradually engaged with concurrent gradual disengagement of the brake 42 in order to permit selective reeling-in of the cable 20.

Figure 3:
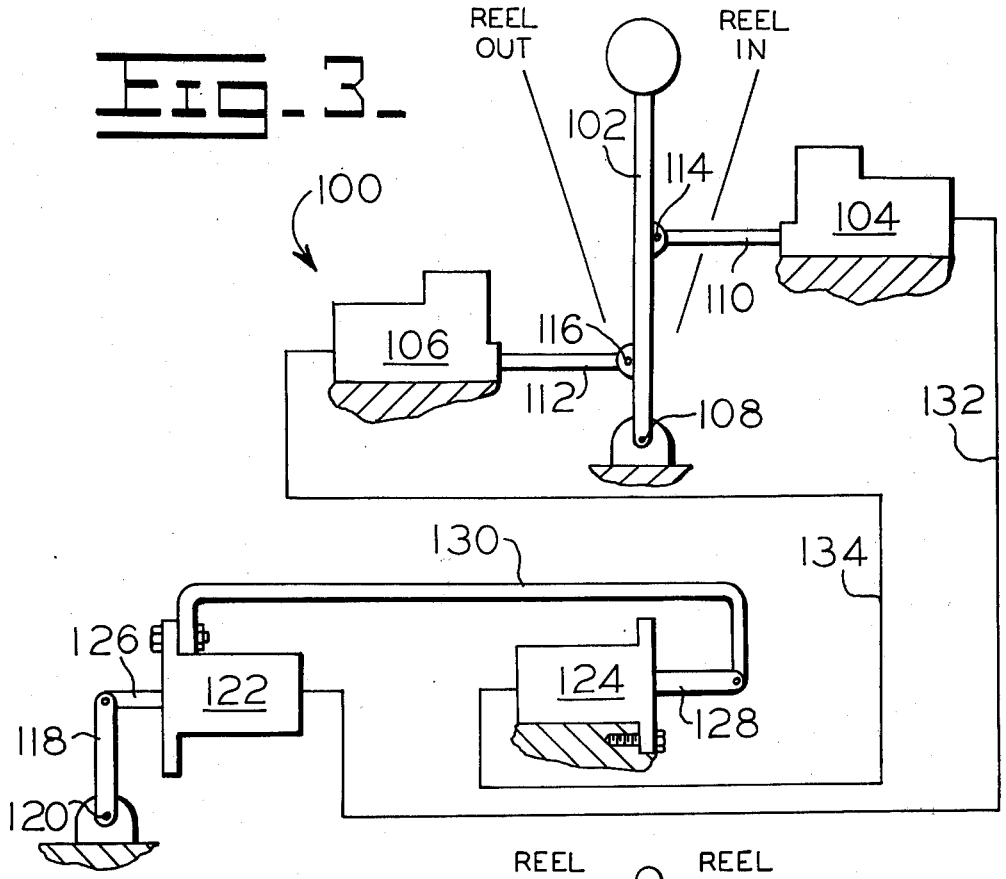
FIG. 3 is a generally schematic representation of a pilot control mechanism constructed according to the present invention for regulating operation of the drive train of FIG. 2 and the winch unit of FIG. 1.
Figure 4:
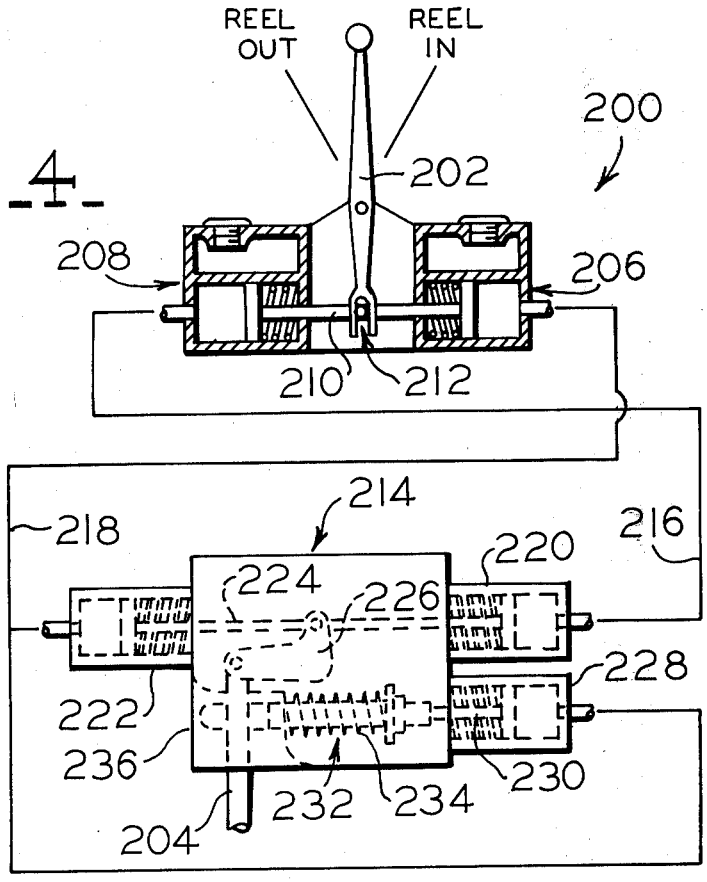
FIG. 4 is another generally schematic representation of yet another embodiment of the pilot control mechanism.

A pilot control mechanism constructed according to the present invention for accomplishing these functions in a relatively simple manner is better illustrated in FIGS. 3 and 4. The pilot control mechanism illustrated in each of FIGS. 3 and 4 includes a pilot controlled lever operatively coupled with the normally engaged brake and normally disengaged clutch. A manual control lever is interconnected with the pilot controlled lever by means of master and slave cylinders suitably arranged in order to provide variable modulated control over the brake and clutch with proportional feedback forces being developed in the manual control lever in order to facilitate closer operator control over the winch unit.

The Pilot Control Mechanism of FIG. 3

Referring now to FIG. 3, a pilot controlled mechanism 100 for operating the power train of FIG. 2 and the winch unit of FIG. 1 includes a manual control lever 102 coupled with opposed hydraulic master cylinders 104 and 106. The manual control lever has a pivot or fulcrum point as indicated at 108 while the cylinders 104 and 106 have respective rods 110 and 112 which are pivotably connected to the lever 102 at 114 and 116 respectively.

A pilot controlled lever 118 has a pivot or fulcrum point 120 while being pivotably coupled with hydraulic slave cylinders 122 and 124. The slave cylinder 122 has an extendable rod 126 which is directly coupled with the pilot controlled lever 118. The cylinder 122 itself is fixed for longitudinal movement with a rod 128 for the other cylinder 124 by means of an interconnecting link 130. The cylinder 124 is fixed against movement and the two slave cylinders 122 and 124 are in respective communication with the master cylinders 104 and 106 by means of conduits 132 and 134.

The pilot controlled lever 118 is operatively coupled with the normally engaged brake and normally disengaged clutch within the drive train of FIG. 2 by conventional means. For purposes of the present invention, it is sufficient to understand that as the pilot controlled lever 118 is moved rightwardly as viewed in FIG. 3, the normally engaged brake is gradually released to permit reeling-out of the winch unit in FIG. 1. On the other hand, leftward movement of the pilot controlled lever 118 results in gradual disengagement of the brake and modulated engagement of the clutch for conventional reeling-in operation of the winch unit. These two functions are accomplished by movement of the manual control lever 102.

Different rates of modulation for reeling-in and reeling-out operation of the winch unit are provided by the axial locations for the pivotable couplings 114 and 116 along the manual control lever 102 relative to its pivot or fulcrum point 108. Since the cylinders 104, 106 and 122, 124 are of generally equivalent size, the differential locations for the pivotable couplings 114 and 116 also serve to develop feedback force tending to resist further movement of the control lever 102 directly in proportion to movement of the pilot controlled lever 118. Stated in another way, it may be seen that a relatively long lever arm is provided between the pivot point 108 and 114 when the manual control lever 102 is shifted rightward for reeling-in operation of the winch unit. A relatively short lever arm is provided between the pivot points 108 and 116 when the manual control lever 102 is shifted leftwardly for reeling-out operation of the winch unit.

The Pilot Control Mechanism of FIG. 4

Referring now to FIG. 4, another pilot control mechanism is indicated at 200 and includes a similar manual control lever 202 and pilot controlled lever 204. The pilot controlled lever 204 is coupled with the drive train of FIG. 2 in a similar manner as described above for the pilot controlled lever 118 of FIG. 3.

Master cylinders 206 and 208 are portions of a double acting cylinder having a common rod pivotably connected with the manual control lever 202 as indicated at 212.

The master cylinders 206 and 208 are in respective communication with a slave unit 214 by means of respective conduits 216 and 218. The slave unit 214 includes opposed cylinders 220 and 222 having a common reciprocable rod as indicated at 224. The common rod 224 is pivotably interconnected with the pilot controlled lever 204 by means of an interconnecting link 226.

An additional accumulator cylinder 228 is included within the slave unit 214 to provide the differential modulation and to produce proportional feedback within the manual control lever 202. The accumulator cylinder 228 is also in communication with the conduit 218. The accumulator cylinder 228 includes an extendable rod 230 which is not directly linked with the pilot controlled lever 204. Rather, the rod 230 merely operates against a load provided by a spring biased mechanism 232. A spring 234 within the mechanism 232 interacts between the rod 230 and a housing 236 for the slave unit 214 in order to provide such a load.

With this arrangement, as the manual control lever 202 is moved rightwardly, as viewed in FIG. 4, the master cylinder 208 causes the slave cylinder 220 to shift the pilot controlled lever 204 leaftwardly in order to gradually release the normally engaged brake and gradually engage the normally disengaged clutch for the drive train of FIG. 2.

As the manual control lever 202 is moved leftwardly toward a reeling-out position, fluid under pressure from the master cylinder 206 is communicated to both the slave cylinder 222 and the accumulator cylinder 228.

This arrangement does not provide an actual variation in force applied to the pilot controlled lever 204 as in the embodiment of FIG. 3. However, additional operator effort is required to move the manual control lever 202 leftwardly because of the additional resistance provided by the accumulator cylinder 228. Accordingly, the slave unit 214 of the pilot control mechanism 200 similarly functions to provide closer modulation during a reeling-out mode of operation for the winch unit of FIG. 1 in a similar manner as described above for the embodiment of FIG. 3.

Preferably, the master cylinders 206 and 208 are of equivalent size and force as are the slave cylinders 220 and 222. The force of the spring mechanism 232 is selected to be equal to or slightly less than the force required to actuate the normally disengaged clutch and the normally engaged brake (see FIG. 2).

Two different embodiments of a pilot control mechanism have been disclosed for accomplishing different rates of modulation with proportional feedback being developed in a manual control lever. The embodiment of FIG. 3 accomplishes these purposes by providing different moment arms through which a manual control lever acts to position opposed master cylinders. The embodiment of FIG. 4 accomplishes the same results through balanced master and slave cylinders while including an additional accumulator cylinder for increasing resistance for movement of the manual control lever in one direction. It is obvious that these purposes could be achieved through other pilot control mechanisms as well, for example, a mechanism similar to that described above with reference to FIG. 3 with different cylinder sizes accomplishing the same purpose as the different moment arms. Accordingly, the scope of the present invention is defined only by the following appended claims.

The control mechanism of this invention may also be employed in other powertrains, for example, such as the reversible towing winch of U.S. Patent 3,729,171 also assigned to the assignee of the present invention.

I claim:

1. A pilot control mechanism for a power train including interrelated first and second hydraulically operable motor means, said first motor means operable to permit reeling out of a cable around a drum, and said second motor means operable to reel in said drum the pilot control mechanism comprising a pilot controlled lever being pivotably movable in a first direction for actuating the first motor means and in a second direction for actuating the second motor means, a manual control lever also being pivotably movable in first and second directions, first and second master cylinder means being coupled with the manual control lever, first and second slave cylinder means being coupled with the pilot controlled lever and being in direct fluid communication with the first and second master cylinder means, and accumulator means, also being in direct fluid communication with only one of the master cylinder means, to produce a resilient load upon movement of the manual control lever in its first direction, the accumulator means providing increased resistance to movement of the control lever in the first direction in relation to movement of the lever in the second direction so that a differential modulated control is provided over the first and second motor means with proportional feedback forces being developed in the manual control lever.

2. The pilot control mechanism of claim 1 wherein the accumulator means comprises an additional accumulator cylinder for receiving fluid from one of the master cylinder means, the accumulator cylinder having an extendable rod operatively coupled with a spring mechanism providing the resilient load.

* * * * *